US007484912B1

(12) United States Patent
Cheek

(10) Patent No.: US 7,484,912 B1
(45) Date of Patent: Feb. 3, 2009

(54) METHOD AND APPARATUS FOR CONSOLIDATING CONCRETE TEST SAMPLES

(76) Inventor: Mark Cheek, 701 Beverly Garden Dr., Metairie, LA (US) 70002

( * ) Notice: Subject to any disclaimer, the term of this patent is extended or adjusted under 35 U.S.C. 154(b) by 122 days.

(21) Appl. No.: 11/700,317

(22) Filed: Jan. 31, 2007

(51) Int. Cl.
*E01C 19/32* (2006.01)

(52) U.S. Cl. ..... 404/133.1

(58) Field of Classification Search ..... 404/133.05, 404/133.1, 133.2; 405/271
See application file for complete search history.

(56) References Cited

U.S. PATENT DOCUMENTS

| | | | | | |
|---|---|---|---|---|---|
| 868,238 | A * | 10/1907 | Wheeler | 425/469 |
| 1,107,976 | A * | 8/1914 | McCoy | 425/469 |
| 1,973,176 | A * | 9/1934 | Richardson | 404/83 |
| 2,841,061 | A * | 7/1958 | Starr | 404/133.1 |
| 2,870,696 | A * | 1/1959 | Yoch | 404/133.1 |
| 3,863,494 | A * | 2/1975 | Nasser | 73/54.03 |
| 4,082,471 | A * | 4/1978 | Hiszpanski | 404/133.1 |
| 4,141,310 | A | 2/1979 | Rich, Jr. | |
| 4,562,672 | A | 1/1986 | Westplate | |
| 5,437,181 | A * | 8/1995 | Nasser | 73/54.03 |
| 6,760,974 | B1 | 7/2004 | Jorgenson | |
| 6,817,242 | B1 | 11/2004 | Moran | |
| 6,964,115 | B2 | 11/2005 | Kim | |
| 2006/0165488 | A1 * | 7/2006 | Morris et al. | 404/133.1 |

* cited by examiner

*Primary Examiner*—Gary S Hartmann
(74) *Attorney, Agent, or Firm*—Kenneth L Tolar

(57) ABSTRACT

A method and an apparatus for consolidating concrete test samples include a tubular tamping rod with a reference disc slidably mounted thereon. When performing a quality control test, a worker pours a concrete specimen into a test container. The tamping rod is positioned adjacent to the container with its lower end at a maximum acceptable submersion depth relative to the specimen. The reference disc is then positioned to engage the upper edge of the container when the lower end of the rod is at the maximum acceptable submersion depth. When the worker reciprocates the tamping rod within the specimen, engagement of the reference disc with the upper edge of the container indicates that the lower end of the rod has reached the maximum acceptable submersion depth.

5 Claims, 3 Drawing Sheets

METHOD AND APPARATUS FOR CONSOLIDATING CONCRETE TEST SAMPLES

CROSS REFERENCE TO RELATED APPLICATIONS

None.

BACKGROUND OF THE INVENTION

The present invention relates to a method and apparatus for consolidating concrete test samples.

DESCRIPTION OF THE PRIOR ART

When erecting concrete structures, workers often perform a variety of field quality control tests to verify the quality and consistency of the concrete being poured. A popular control procedure is a slump test that essentially measures the fluidity of the concrete. A slump test is performed by sequentially pouring multiple layers of a concrete specimen into a frusto-conical or cylindrical container. A first layer having a predetermined depth or volume is initially placed into the container and a tamping rod is reciprocated therein. When reciprocating the rod, the worker attempts to extend the lower end as far as possible into the concrete layer without engaging the bottom surface of the container. Once the tamping rod is reciprocated a prescribed number of times, a second layer of equal depth or volume is poured onto the first layer. The tamping rod is again reciprocated within the second layer, and a minimal distance into the first layer (but no farther), a prescribed number of times. A third layer is added to the container and the tamping process is repeated as described above. Once the tamping procedure is completed, the container is lifted and the concrete is allowed to slump. The height differential between the top edge of the container and the displaced top surface of the dumped concrete is measured to quantify the slump.

Tamping concrete as described above has numerous disadvantages. Because the worker must estimate the depth of each concrete layer, he or she often inadvertently thrusts the rod against the bottom of the container or otherwise submerges the rod to an improper depth; if the rod impacts the container or is not properly submersed, the accuracy of the test is negatively impacted. In order to more accurately gauge the proper submersion depth, the worker may initially position the tamping rod adjacent the container with its lower end at the maximum acceptable depth. The worker then grasps the tamping rod at a height equal to that of the upper end of the container. Accordingly, if the worker thrusts the rod downwardly until the hand engages the top of the container, the worker is somewhat assured that the lower end of the rod has substantially penetrated the layer without engaging the bottom of the container. However, repeatedly striking the container with one's hand is uncomfortable, painful and requires the worker to stoop or crouch.

Several concrete leveling devices and tools exist in the prior art. However, none of these devices have been designed to address the above described problem. For example, U.S. Pat. No. 4,141,310 issued to Rich, Jr. discloses a floor level indicator including an outer casing that is driven into the ground with a scaled indicator received therein for assisting workers in pouring a floor having a desired height.

U.S. Pat. No. 6,817,242 issued to Moran discloses a concrete level indicator including an elongated post having a float at a lower end thereof. A guide sleeve allows telescoping, vertical movement of the post as the concrete level in a concrete pump hopper varies.

U.S. Pat. No. 5,437,181 issued to Nasser discloses a concrete slump tester including a tube having a perforated lower section and a disc thereon. The tube is inserted into a concrete specimen up to the level of the disc. A measuring unit is inserted into the tube to engage concrete therein. The measuring unit uses an induction coil and a metal cylinder on the tube to determine the depth to which the measuring unit has been inserted. Using the calculated depth, the measuring unit determines the concrete slump.

U.S. Pat. No. 4,562,672 issued to Westplate discloses a stake for supporting screed guides.

U.S. Pat. No. 6,964,115 issued to Kim discloses a rod for leveling the floor of a building.

U.S. Pat. No. 6,760,974 issued to Jorgenson discloses a height indicator for pouring cement floors over an uneven sub-floor.

None of the above referenced documents remotely disclose or suggest a method and apparatus for slump testing concrete as described in detail below.

SUMMARY OF THE INVENTION

A method and an apparatus for consolidating concrete test samples include a tubular tamping rod with a reference disc slidably mounted thereon. When performing a quality control test, a worker pours a concrete specimen into a test container. The tamping rod is positioned adjacent to the container with its lower end at a maximum acceptable submersion depth relative to the specimen. The reference disc is then positioned to engage the upper edge of the container when the lower end of the rod is at the maximum acceptable submersion depth. When the worker reciprocates the tamping rod within the specimen, engagement of the reference disc with the upper edge of the container indicates that the lower end of the rod has reached the maximum acceptable submersion depth.

It is therefore an object of the present invention to provide a method and apparatus for properly consolidating concrete test samples when performing various quality control tests.

It is another object of the present invention to provide a method and apparatus that eliminate the burden and inconvenience associated with performing various quality control tests.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
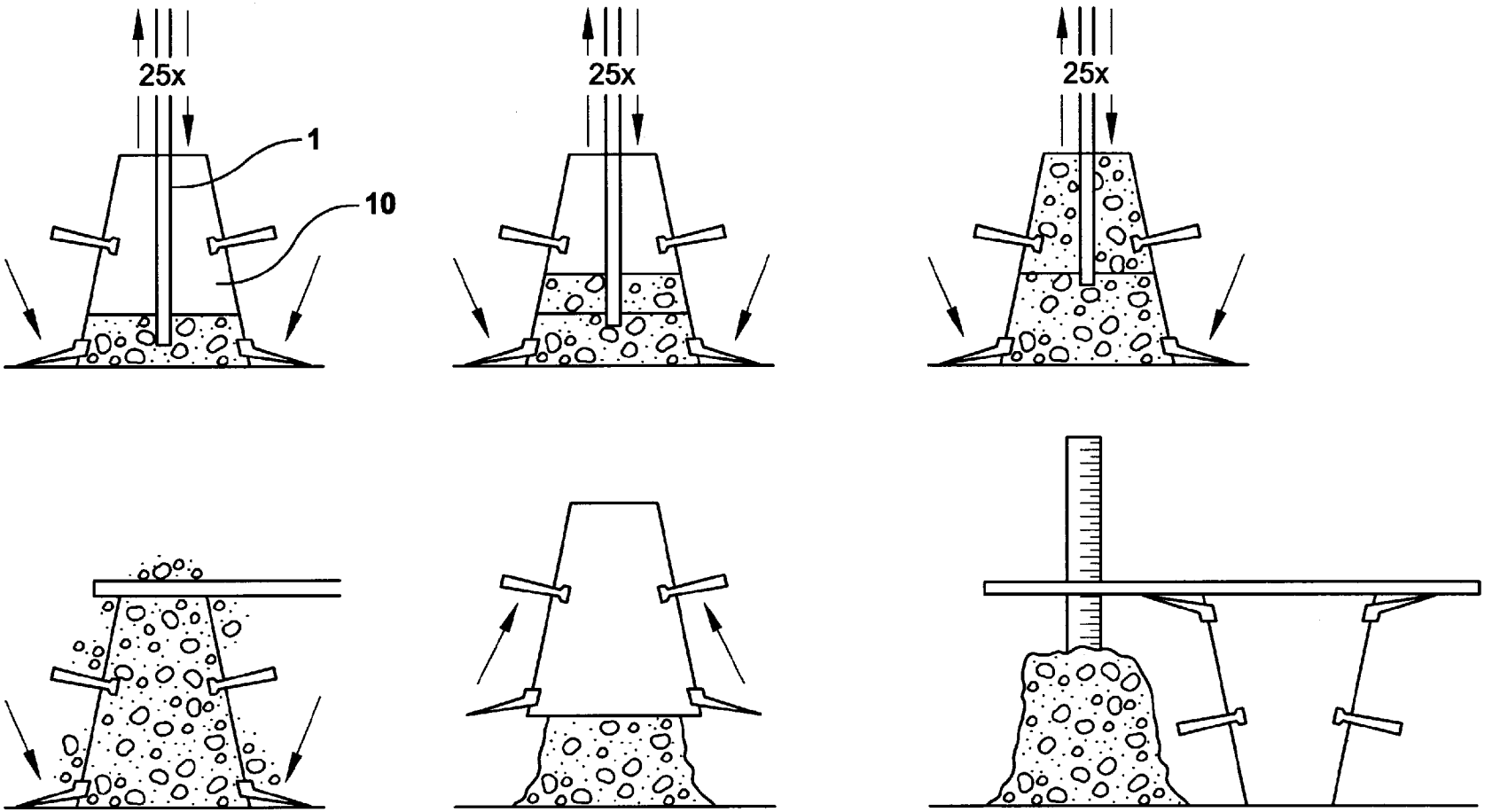
FIG.1 PRIOR ART
FIG. 1 depicts a method of performing a conventional slump test.
Figure 2:
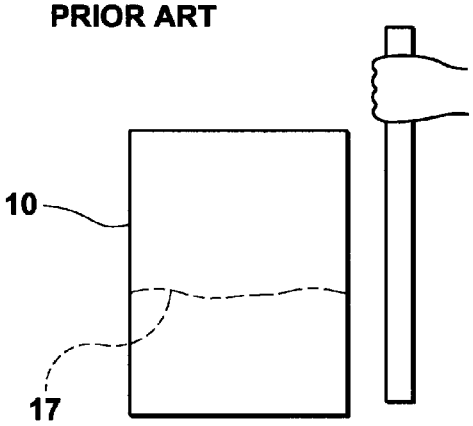
FIG.2 PRIOR ART
FIGS. 2 and 3 depict a worker measuring the proper submersion depth of a tamping rod according to a quality control test.
Figure 3:
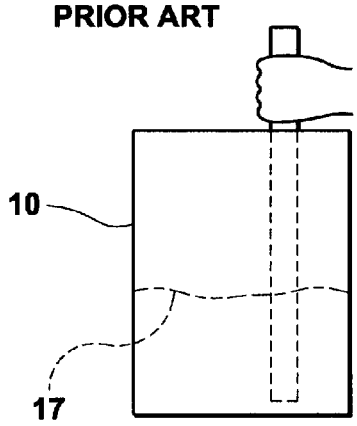
FIG.3 PRIOR ART
Figure 4:
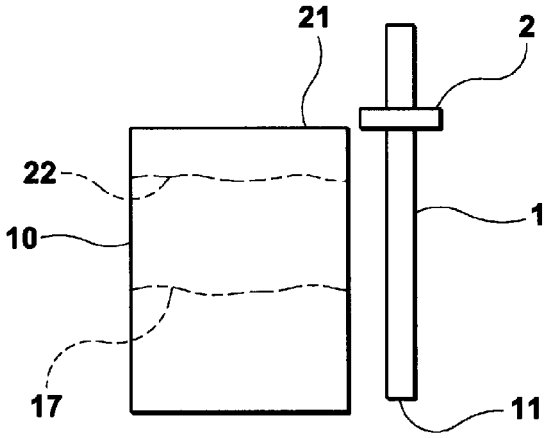
FIGS. 4 and 5 depict a worker determining an appropriate submersion depth using the apparatus and method according to the present invention.
Figure 5:
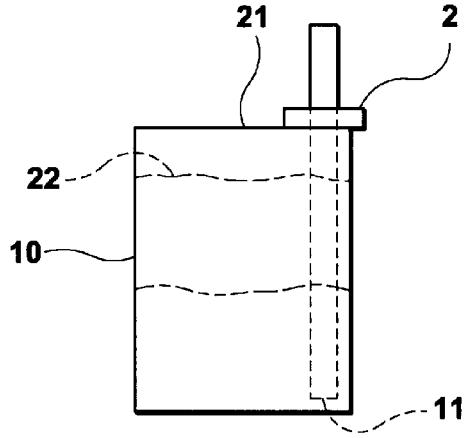
Figure 7:
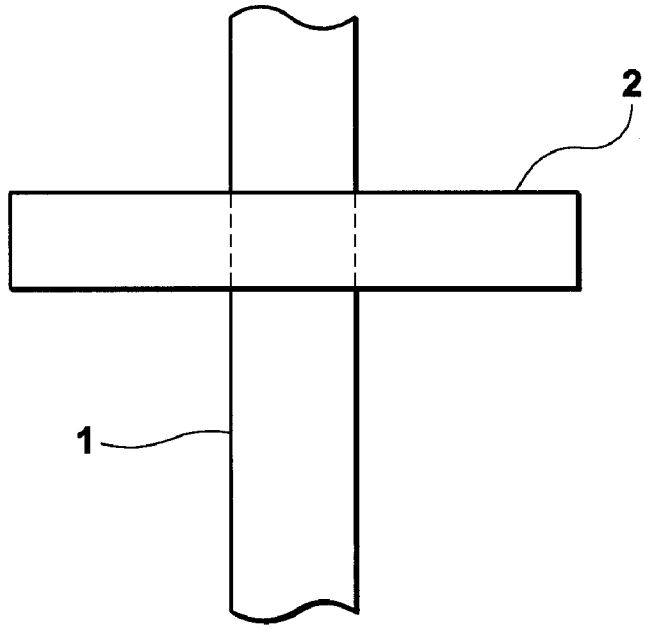
FIG. 7 is a front, plan view of the reference disc mounted on the tamping rod.
Figure 6:
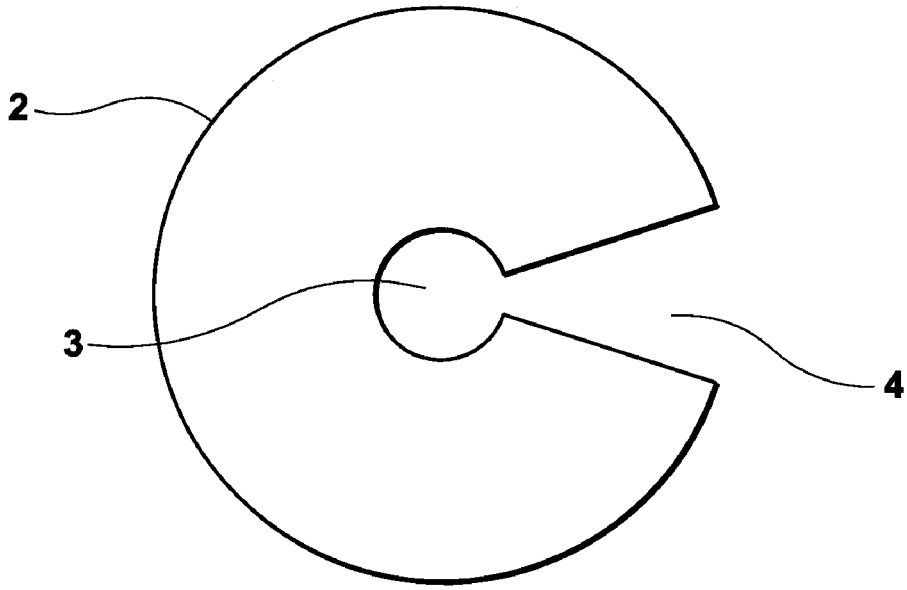
FIG. 6 is a plan view of the reference disc.

The present invention relates to a method and an apparatus for consolidating concrete test samples. The apparatus includes an elongated, tubular tamping rod 1 having a predetermined length and diameter with a substantially circular reference disc 2 slidably mounted thereon. The reference disc includes a central bore 3 for receiving the tamping rod with a wedge-shaped, peripheral notch 4 in communication therewith. The wedge-shaped notch allows the diameter of the bore to expand slightly when receiving the tamping rod; therefore, the tamping rod diameter can be slightly larger than that of the bore to assure a tight, secure fit, even after expected wear and tear.

The method according to the present invention includes using the tamping rod and reference disc described above as follows. A first layer 17 of concrete having a prescribed depth or volume is poured into a frustoconical or cylindrical test container 10. The tamping rod is placed immediately adjacent the container with the lower end 11 thereof positioned at a maximum acceptable depth relative to the concrete layer. The maximum acceptable depth is typically immediately above the bottom of the container. The disc is then slid vertically along the tamping rod to a height equal to the height of the upper edge of the container. The worker then inserts the tamping rod into the container and reciprocates it in a conventional fashion. With each downstroke, the user lowers the rod until the reference disc engages the upper edge 21 of the container, which assures that the lower end of the rod has sufficiently penetrated the concrete layer, but has not impacted the container bottom. A proper test procedure requires the worker to also reciprocate the tamping rod within a central portion of the concrete specimen where the disc cannot engage the container. When performing this aspect of the test, the worker repositions the disc such that it engages the upper surface of the concrete layer when the lower end of the tamping rod is at the maximum acceptable depth.

Subsequent layers (typically, second and third layers are added) are tamped in a similar fashion. For example, a second layer 22 having a volume or depth equal to that of the first layer is poured on top of the first layer; the worker positions the tamping rod adjacent to the container and orients the lower end immediately beneath the interface between the first and second layers. The reference disc is again positioned such that it is resting on or immediately adjacent to the upper edge of the container, and the tamping rod is reciprocated as described above. For tamping a central portion of the second layer, the worker repositions the reference disc to engage the upper surface of the second layer when the lower end of the tamping rod barely surpasses the interface between the first and second layers.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An apparatus for consolidating concrete test samples comprising:

an elongated, tubular tamping rod having a predetermined length and diameter;

a substantially circular reference disc slidably mounted on said tamping rod;

said reference disc including a central bore for receiving the tamping rod with a wedge shaped, peripheral notch in communication therewith, said notch allowing said bore to expand slightly when receiving the tamping rod.

2. A method of tamping concrete comprising the steps of:

pouring a first layer of a concrete specimen into a test container;

positioning a tamping rod immediately adjacent the container with a lower end thereof positioned at a maximum acceptable depth relative to the first layer;

slidably mounting a reference disc on said tamping rod;

positioning the disc on said tamping rod at a height equal to the height of an upper edge of the container;

placing said tamping rod within the first layer;

reciprocating the tamping rod upwardly, and downwardly until said reference disc engages the upper edge of said container thereby assuring that the lower end of the rod has sufficiently penetrated the first layer without impacting a bottom surface of said container.

3. The method according to claim 2 further comprising the steps of:

placing said tamping rod within a central portion of the first layer;

positioning the disc on said rod to engage an upper surface of the first layer when the lower end of the tamping rod is at the maximum acceptable depth.

4. The method according to claim 2 further comprising the steps of:

pouring at least one additional layer of the concrete specimen onto said first layer;

positioning the tamping rod adjacent to the container and orienting the lower end thereof immediately beneath an interface between said first layer and said additional layer;

positioning the disc on said tamping rod at a height equal to the height of an upper edge of the container;

placing said tamping rod within the additional layer;

reciprocating the tamping rod upwardly, and downwardly until said reference disc engages the upper edge of said container thereby assuring that the lower end of the rod surpasses the interface between said first layer and said additional layer by a minimal distance.

5. The method according to claim 4 further comprising the steps of:

placing said tamping rod within a central portion of the additional layer;

positioning the disc on said rod to engage an upper surface of the additional layer when the lower end of the tamping rod has surpassed the interface between said first layer and said additional layer.

* * * * *